US005245160A

United States Patent [19]

Quabeck et al.

[11] Patent Number: 5,245,160

[45] Date of Patent: Sep. 14, 1993

[54] HEAT PIPE ROLLER WITH TEMPERATURE SENSOR

[75] Inventors: Helmut Quabeck, Babenhausen, Fed. Rep. of Germany; Martin Hughes, Buckinghamshire, United Kingdom

[73] Assignee: E. I. Du Pont de Nemours and Company, Wilmington, Del.

[21] Appl. No.: 913,641

[22] Filed: Jul. 15, 1992

[30] Foreign Application Priority Data

Jul. 18, 1991 [GB] United Kingdom ..... 9115518

[51] Int. Cl.[5] ..... B21B 27/06; H05B 3/02

[52] U.S. Cl. ..... 219/471; 219/469; 219/470; 432/60; 432/228

[58] Field of Search ..... 219/216, 469, 470, 471; 432/60, 228; 29/113.1, 113.2

[56] References Cited

U.S. PATENT DOCUMENTS 2,011,748 8/1935 Boyd ..... 219/469
3,185,816 5/1965 Lusebrink ..... 219/469
4,105,896 8/1978 Schuster ..... 219/470

FOREIGN PATENT DOCUMENTS 53-26133 3/1978 Japan ..... 219/471

*Primary Examiner*—Bruce A. Reynolds
*Assistant Examiner*—Michael D. Switzer
*Attorney, Agent, or Firm*—Thomas H. Magee

[57] ABSTRACT

A heat pipe roller includes a rotatable outer tube having a primary internal chamber for containing a fluid, a heater operable to heat the fluid and hence the tube, and a sensor. The sensor has a movable member which communicates with the primary chamber and is mounted on the tube for rotation therewith, and a fixed member situated in the region of the axis of rotation of the tube and so mounted relative to the tube that rotation of the tube does not rotate the fixed member. The fixed member is adapted to be connected to equipment for measuring an electrical characteristic of the sensor. The arrangement is such that, in use, the movable member moves in response to a temperature change or temperature related physical change in the primary chamber, thereby causing a corresponding change in the electrical characteristic of the sensor.

11 Claims, 2 Drawing Sheets

HEAT PIPE ROLLER WITH TEMPERATURE SENSOR

BACKGROUND OF THE INVENTION

FIELD OF THE INVENTION

The invention pertains to a heat pipe roller and, more particularly, to a temperature sensor for use in the heat pipe roller.

DESCRIPTION OF RELATED ART

A heat pipe roller is a device which includes a rotatable outer tube having an internal chamber. The chamber contains a liquid which, in use, is heated by an internal or external heater, causing some of the liquid to evaporate. Some of the vapor so formed may then condense on the inner surface of the outer tube, giving out latent heat of condensation and so warming the outer tube.

In one known form of heat pipe roller, the outer tube is sealed at its ends to corresponding ends of a concentric inner tube to form a closed annular chamber between the tubes. The chamber is evacuated, and contains a liquid in equilibrium with its vapor, and a wick formed from multiple layers of fine mesh material is provided on the outer diameter of the inner tube. The liquid in the chamber fills this wick by capillary action. A radiant heater, for example, a linear resistance heater, is used to heat the inner surface of the inner tube, causing liquid in the chamber to evaporate and then condense on the inner surface of the outer tube, giving out latent heat of condensation in the process. If a given area of the outer tube becomes cooler than other parts of the tube, for example, as a result of the application of cooler material to the tube, then the rate of condensation at the cooled area increases. This transfers more heat to that area, and thus then tends to return it to the same temperature as the other parts of the tube. It is thus possible to maintain a relatively uniform temperature distribution over the outer tube, with variations in the rate of condensation of vapor in the chamber tending to compensate for variations in surface temperature of the outer tube. Examples of such a device are shown in U.S. Pat. Nos. 4,172,976 and 4,229,644 (Namiki et al.).

Heat pipe rollers are particularly suitable for use in apparatus for developing photographic images on film using the "dry silver" process. In such apparatus, the film is held in intimate contact with the outer surface of the outer tube by means of a flexible belt, and the heat pipe roller functions to provide the even heating of the film to an accurately determined temperature that is required to develop the image. Published data and experimentation shows that it is possible to maintain surface temperatures which vary by no more than ±0.5° C. over the outer surface of the outer tube of a heat roller. In order to monitor the temperature of such rollers, it is known to use temperature or pressure sensors which monitor the temperature or pressure, as appropriate, of the vapor in the chamber. The known sensors are mounted on the rotating roller, and slip rings are normally used to connect the sensors to the appropriate control and measurement equipment (which does not rotate with the roller).

One disadvantage of this arrangement is that the slip rings, particularly when operating at low speed, generate electrical noise which can interfere with the signal from the heat pipe temperature or pressure sensor. This noise tends to reduce or negate the advantages of accurate temperature control that the heat pipe roller is intended to provide. Furthermore, slip rings increase the complexity and cost of the apparatus. In order to avoid the need for slip rings, it has been proposed to transmit the signal from a sensor by means of inductive, capacitive, optical or radio frequency coupling between the heat pipe roller and frame on which it is mounted. However all these arrangements require heat-resistant electronic circuits to be mounted on the roller, and are consequently costly to produce.

A further disadvantage of known heat pipe rollers arises from the formation of non-condensable gas, typically hydrogen, within the chamber as a result of corrosion or catalytic action therein. Such gas makes no significant contribution to the transfer of heat to the outer tube, but can blanket the inner surface of the outer tube, thus effectively inhibiting or preventing the operation of the pipe by preventing vapor from reaching that surface. In known systems, attempts to mitigate this problem involve the careful selection of liquid and tube materials, and attention to cleanliness during manufacture of the heat pipe roller.

SUMMARY OF THE INVENTION

The present invention comprises a heat pipe roller including a rotatable outer tube having a primary internal chamber for containing a fluid, a heater operable to heat the fluid and hence the tube, and a sensor. The sensor comprises a movable member which communicates with the primary chamber and is mounted on the tube for rotation therewith, and a fixed member situated in the region of the axis of rotation of the tube and so mounted relative to the tube that rotation of the tube does not rotate the fixed member. The fixed member is adapted to be connected to equipment for measuring an electrical characteristic of the sensor. The arrangement is such that, in use, the movable member moves in response to a temperature change or temperature related physical change in the primary chamber, thereby causing a corresponding change in the electrical characteristic of the sensor.

DETAILED DESCRIPTION OF THE PREFERRED EMBODIMENT

Figure 1:
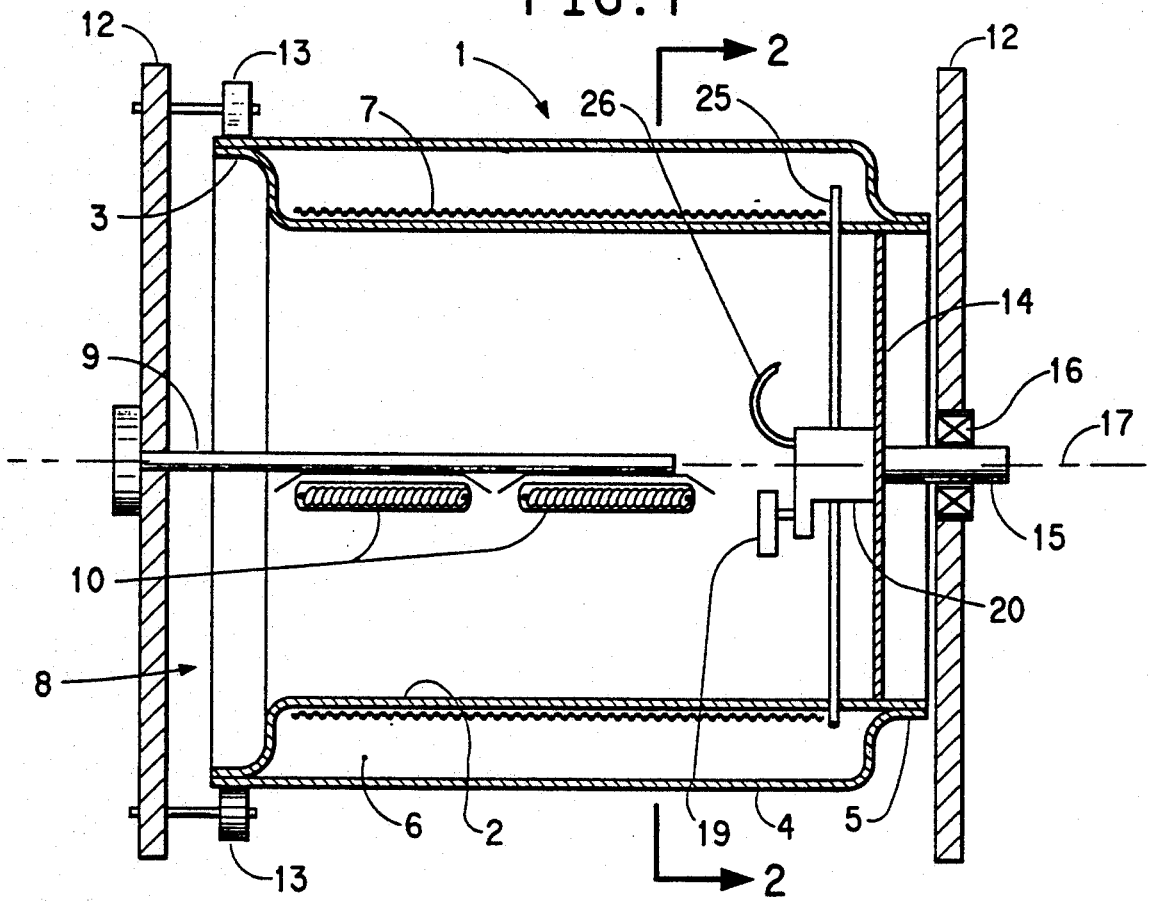
FIG. 1 is a cutaway elevation view of a heat pipe roller according to the invention.
Figure 2:
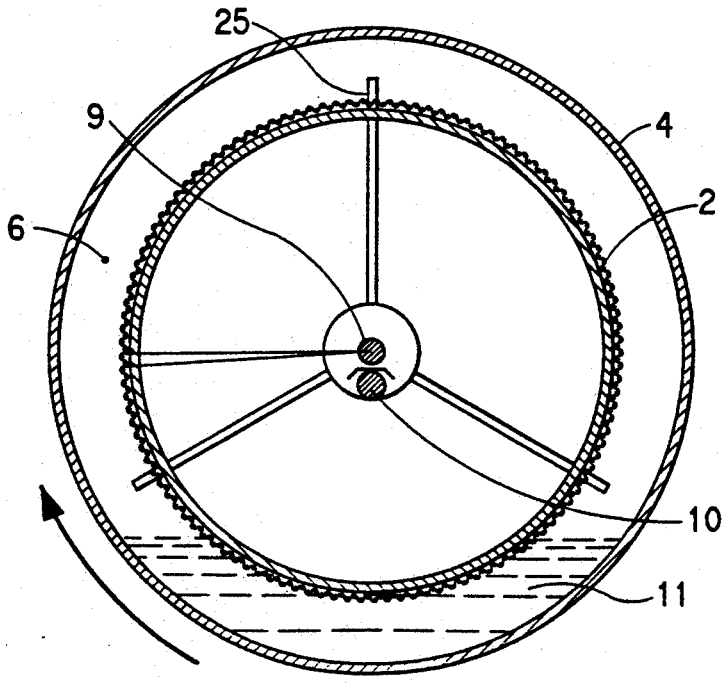
FIG. 2 is a cross-sectional view taken along line 2—2 of FIG. 1.

FIGS. 1 and 2 show a heat pipe roller 1 comprising an inner tube 2 having an enlarged diameter end portion 3 at one end, and an outer tube 4 having a reduced diameter end portion 5 at the other end. The portions 3 and 5 form two end lips at which the tubes 2 and 4 are sealed together so as to define a closed annular primary chamber 6 therebetween. The chamber 6 is evacuated, contains a mesh wick 7 wound onto the outer surface of the inner tube 2, and also contains water in equilibrium with its vapor. The water tends to collect in a pool 11 (FIG. 2) in the bottom of the chamber 6, and also is absorbed by the wick 7.

The tubes 2 and 4 are open at one end 8 into which an axial arm 9 projects. The arm 9 carries two radiant heaters 10 which are operable to heat the liquid in the chamber 6, causing the liquid to evaporate and subsequently condense on the inner surface of the outer tube 4. The heaters 10 may be linear resistance heaters or Infra Red Tungsten Halogen lamps. The open end of the tubes 2 and 4 is supported on a frame 12 by means of support rollers 13. The other end of the tubes is closed by an end plate 14 from which a tube shaft 15 projects. The stub shaft 15 is mounted on the frame 12 via bearings 16 which allow the shaft 15, and hence the tubes 2 and 4, to rotate about an axis 17. A known drive mechanism (not shown) is also mounted on the frame 12, and is operable to rotate the tubes 2 and 4 about the axis 17. The stub shaft 15 carries some of the components of a sensor 20 for measuring the vapor pressure, and hence the temperature, within the chamber 6.

Figure 3:
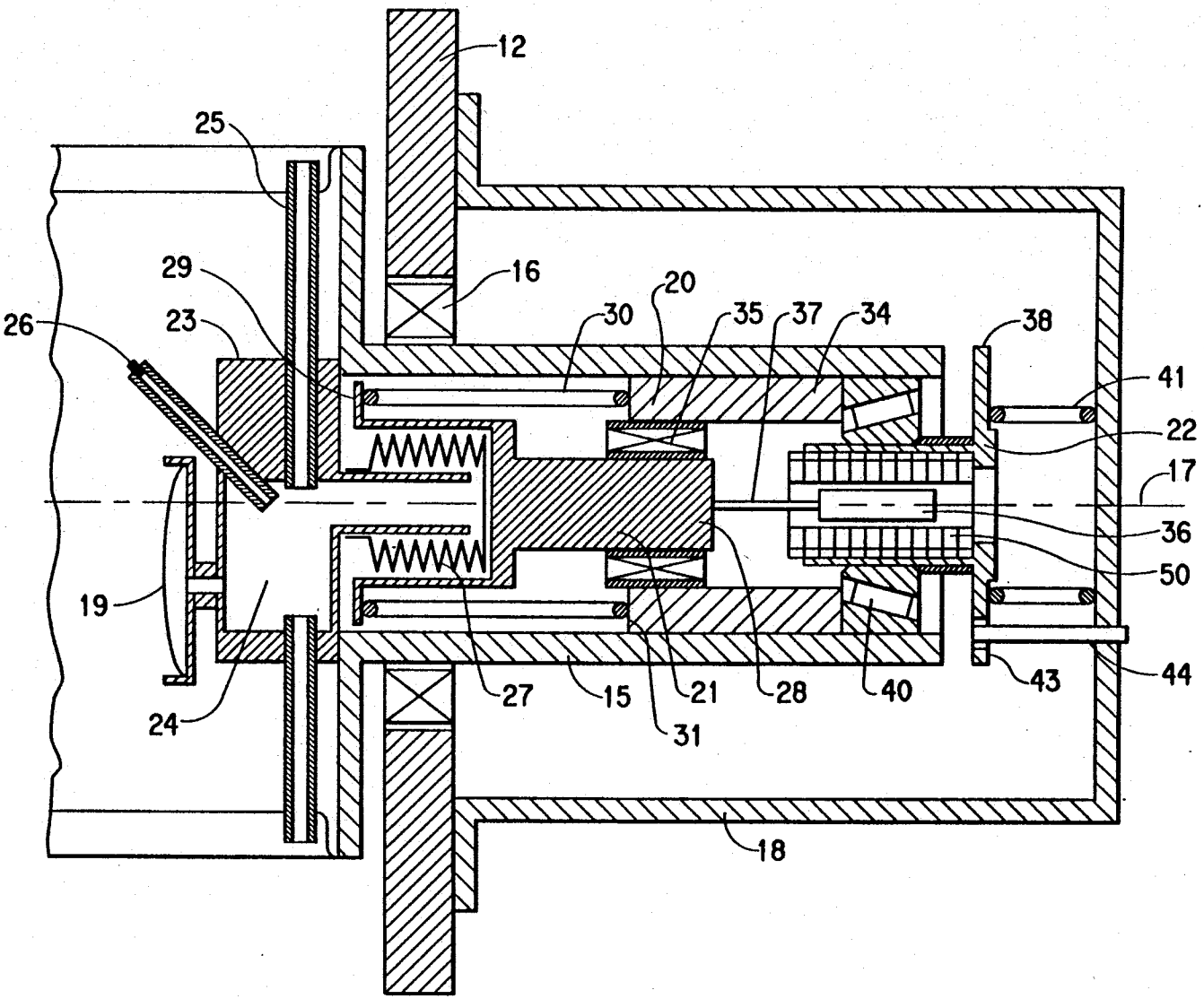
FIG. 3 is an enlarged cross-sectional view of a temperature sensor forming part of the heat pipe roller of FIGS. 1 and 2.

FIG. 3 shows the stub shaft 15 situated within an end cap 18. The sensor 20 comprises a movable member 21 and a fixed member 22. The movable member 21 includes a central body 23 having a secondary chamber 24. The central body 23 is located in the region of the axis 17. The secondary chamber 24 communicates with the primary chamber 6 through three radial pipes 25 which project through bores in the inner tube 2 and the central body 23. In addition, the secondary chamber 24 also communicates with a sealable filling and evacuation tube 26, a bellows 27, and a pressure relief device comprising a burst disk 19.

The bellows 27 is attached to a carrier 28 having an end flange 29. A compression spring 30 acts between the flange 29 and a shoulder 31 formed at one end of a sleeve 34 attached to the stub shaft 15. The carrier 28 is retained in axial position at one end by means of a linear bearing 35, and is also attached to a cylindrical core piece 36 which is carried on the end of a shaft 37, and forms part of a linear variable differential transformer (LVDT). It will be seen that the core piece 36 forms part of the movable member 21. The LVDT has coils 50 which are attached to an end piece 38 forming part of the fixed member 22, and includes connectors (not shown) for connecting the coils 50 to appropriate control and measurement equipment. The end piece 38 is mounted on the shaft 15 via tapered roller bearings 40 against which the end piece 38 is held by means of a compression spring 41 acting between the end cap 18 and end piece 38. The end piece 38 also includes a through-bore 43 into which a peg 44 projects.

In use, as the tubes 2 and 4 rotate, the body 23, bellows 27, carrier 28 and core piece 36 also rotate about the axis 17. However, any tendency of the fixed member 22 to rotate with the rest of the roller 1 is resisted by the torsional load in the spring 41 and the engagement of the peg 44 in the bore 43. Any increase in temperature in the primary chamber 6 will cause a corresponding increase in vapor pressure which will, in turn, cause the bellows 27 to expand against the biasing action of the spring 30. This movement will, in turn, move the carrier 28, and hence the core piece 36 along the axis 17 towards the spring 41 The consequent change in position of the core piece 36 relative to the coils 50 will cause a variation in the output of the LVDT. It will be seen that a reduction in temperature in the chamber 6 will have the opposite effect. Thus changes in pressure in the chamber 6 (resulting from temperature changes) will be translated into relative axial movement between the rotating core piece 36 and the stationery coils 50, which may be detected using conventional electronic circuits. The core piece 36 is free to move in the coils 50 with an annular clearance at all times.

Since the coils 50 do not rotate, the heat pipe roller 1 avoids the need for the use of slip rings. In addition, no electronic circuitry needs to be incorporated into the movable member 21. The secondary chamber 24 is located at a relatively cool part of the heat pipe roller 1, as a result of which non-condensible gases formed in the primary chamber 6 will tend to accumulate in the secondary chamber 24. Should the pressure in the secondary chamber 24 exceed a predetermined safety limit, the disk 19 will burst, enabling that pressure to be released. The system as described is also believed to be substantially without hysteresis, other than that provided by the linear bearing 35 (which is an optional feature). The heat pipe roller 1 is intended to be used in film processing apparatus, in which a film is held in intimate contact with the roller 1 which rotates as film is drawn through the processing apparatus.

In the preferred embodiment, the heat piper roller 1 comprises a rotatable outer tube 4 having a primary internal chamber 6 for containing a fluid, a heater 10 operable to heat the fluid and hence the tube 4, and a sensor 20. The sensor 20 comprises a movable member 21 which communicates with the primary chamber 6 and is mounted on the tube 4 for rotation therewith, and a fixed member 22 situated in the region of the axis 17 of rotation of the tube 4 and so mounted relative to the tube 4 that rotation of the roller 1 does not rotate the fixed member 22. The fixed member 22 is adapted to be connected to means for measuring an electrical characteristic of the sensor 20. The arrangement is such that, in use, the movable member 21 moves in response to a temperature change or temperature related physical change in the chamber, causing a corresponding change in the electrical characteristic of the sensor 20. Preferably, the fixed member 22 comprises an electrically conductive element through which, in use, an electric current is passed, the movable member 21 being movable so as to vary the distance between the fixed and movable members, which movement causes the inductance of the sensor 20 to vary. That movement of the movable member 21 is preferably along the axis 17 of rotation of the outer tube. Preferably, the fixed member 22 comprises at least one coil, and the movable member 21 comprises a ferromagnetic element. Since the electrical characteristic of the sensor 20 may be monitored by measuring means connected to the fixed member 22, the invention avoids the need for slip rings.

The sensor 20 may with advantage comprise a variable differential transformer, having primary and secondary coils provided on the fixed member 22 and a core piece 36 provided on the movable member 21. In this case, the signal produced by the transformer will be the voltage induced in its secondary coils which will be a function of the amplitude and frequency of the voltage fed to the primary coils and of the relative position of the core piece 36.

Although the heat pipe roller 1 is intended to rotate about an axis 17 which coincides with the axis of the tube, any inaccuracy in construction of the roller or of its mounting may lead to a difference in the relative positions of these two axes, which would be seen in use as a "wobble" in the movement of the rotating roller 1. It is therefore preferred that the fixed member 22 is mounted on the roller 1 by means of bearings 40 which enable the roller 1 to rotate about its axis relative to the fixed member 22. This feature tends to prevent the position of the movable member 21 relative to the fixed member 22 from being affected by any "wobble" in the movement of the roller 1. In this case, the bearings 40 are preferably tapered, with the fixed member 22 being urged against the bearings 40 by a biasing means such as a compression spring 41. Where the movable member 21 includes a core piece 36, this may with advantage be circularly symmetric about an axis which is substantially coaxial with the axis of the roller 1.

The movable member 21 may move directly in response to temperature changes, but preferably moves in response to changes in vapor pressure in the primary chamber 6, which are related to the temperature changes. The internal pressure of the chamber 6 will be the vapor pressure of the fluid at the pipe condensing temperature, i.e., the temperature of the inner surface of the roller. By correct selection of the fluid with regard to the required operating temperature it can be arranged such that a small change in temperature results in a large change in internal pressure.

The movable member 21 may comprise a bellows 27. Where the heat pipe roller 1 comprises an inner tube 2 and an outer tube 4 between which the primary chamber 6 is defined, the bellows 27 may be mounted on the axis 17 of the roller 1 and communicate with the primary chamber 6 via one r more conduits, for example, radial pipers 25. In such an arrangement, there is preferably also provided a secondary chamber 24 which is situated adjacent to the bellows 27 and also communicates with the other chamber 6, the arrangement being such that, in use, the secondary chamber 24 is substantially cooler than the main chamber 6. Any non-condensible gas generated within the roller will tend to collect initially at the coolest part of the structure, and will thus tend to accumulate in the secondary chamber 24. The secondary chamber 24 thus retards the rate at which the non-condensible gas accumulates in the other chamber 6, and in so doing extends the effective operational life of the roller 1. The secondary chamber 24 may, with advantage, include a pressure relief device, such as a frangible diaphragm, or burst disk 19, for preventing the pressure in the secondary chamber 24 from exceeding a predetermined safety limit.

The present invention lies in a sensor 20 for a heat pipe roller 1 which roller comprises a rotatable outer tube 4, having a primary internal chamber 6 for containing a fluid and a heater 10 operable to heat the fluid, and hence the tube 4. The sensor 20 comprises a movable member 21 adapted to communicate with the primary chamber 6 and to be mounted on the tube 1 for rotation with the latter. A fixed member 22 is adapted to be mounted in a position in the region of the axis 17 of the roller 1 in such a way that rotation of the roller 1 does not rotate the fixed member 22, and is adapted to be connected to means for measuring an electrical characteristic of the sensor 20. The arrangement is such that, in use, the movable member 21 moves in response to a temperature change or temperature related physical change in the chamber 6, causing a corresponding change in the electrical characteristic.

In another aspect, the present invention provides a heat pipe roller 1 in which a liquid in an inner primary chamber 6 in a rotatable outer tube 4 is, in use, evaporate by a heater 10 and subsequently condenses on an inner surface of the outer tube 4 to heat the latter. A secondary chamber 24 is provided in the region of the axis 17 of rotation of the roller 1. The secondary chamber 24 communicates with the primary chamber 6 and is situated in a relatively cool region of the roller 1 so that non-condensible gas produced as a result of operation of the roller 1 tends to collect in the secondary chamber 24.

The secondary chamber 24 may be provided in combination with the sensor 20 as, for example, an integral chamber in the fixed member 22. However, it is also within the scope of the present invention to provide a heat pipe roller 1 which has the secondary chamber 24 but not the sensor 20 as herein before described.

The present invention is particularly applicable to the development of photographic images on film using the "dry silver" process, and may be used in apparatus for developing such film.

What is claimed is:

1. A heat pipe roller comprising a rotatable outer tube 4 having a primary internal chamber 6 for containing a fluid, a heater 10 operable to heat the fluid and hence the tube, and a sensor 20, characterized in that the sensor 20 comprises a movable member 21 which communicates with the primary chamber and is mounted on the tube 4 for rotation therewith, and a fixed member 22 situated in the region of the axis of rotation of the tube 4 and so mounted relative tot he tube 4 that rotation of the tube 4 does not rotate the fixed member 22, the fixed member 22 being adapted to be connected to means for measuring an electrical characteristic of the sensor 20, the arrangement being such that the movable member 21 moves in response to a temperature change or temperature related physical change in the primary chamber 6, thereby causing a corresponding change in the electrical characteristic of the sensor 20, said movable member 21 comprising a bellows 27 mounted along the axis of the outer tube 4 and communicating with the primary chamber 6 via one or more conduits, said heat pipe roller further comprising a secondary chamber 24 which is situated adjacent to the bellows 27 and also communicates with the primary chamber 6, said secondary chamber 24 being substantially cooler that the primary chamber 6.

2. A heat pipe roller according to claim 1 in which the fixed member 22 comprises an electrically conductive element 50 through which an electric current may be passed, the movable member 21 being movable so as to vary the distance between the fixed and movable members, which movement causes the inductance of the sensor to vary.

3. A heat pipe roller according to claim 2 in which movement of the movable member is along the axis of rotation of the outer tube 4.

4. A heat pipe roller according to claim 3 in which the fixed member 22 comprises at least one coil 50, and the movable member 21 comprises a ferromagnetic element 36.

5. A heat pipe roller according to clam 1 in which the heat pipe roller additionally comprises an inner tue 2, the primary chamber 6 being defined between the inner tube 2 and the outer tube 4.

6. A heat pipe roller according to claim 1 in which the secondary chamber 24 includes a pressure relief device 19 for preventing the pressure in the secondary chamber 4 for exceeding a predetermined safety limit.

7. A heat pipe roller according to claim 1 in which the secondary chamber 24 is incorporated into the sensor 20.

8. A heat pipe roller comprising a rotatable outer tube 4 having a primary internal chamber 6 for containing a fluid, a heater 10 operable to heat the fluid and hence the tube, and a sensor 20, characterized in that the sensor 20 comprises a movable member 21 which communicates with the primary chamber and is mounted on the tube 4 for rotation therewith, and a fixed member 22 situated in the region of the axis of rotation of the tube 4 and so mounted relative to the tube 4 that rotation of the tube 4 does not rotate the fixed member 232, the fixed member 22 being adapted to be connected to means for measuring an electrical characteristic of the sensor 20, said sensor comprising a variable differential transformer, having primary and secondary coils 50 provided on the fixed member 22 and a core piece 36 provided on the movable member 21, the arrangement being such that h movable member 21 moves in response to a temperature change or temperature related physical change in the primary chamber 6, thereby causing a corresponding change in the electrical characteristic of the sensor 20.

9. A heat pipe roller according to claim 8 in which the core piece 36 is circularly symmetric about an axis which is substantially coaxial with the axis of rotation of the tube 4.

10. A heat pipe roller comprising a rotatable outer tube 4 having a primary internal chamber 6 for containing a fluid, a heater 10 operable to heat the fluid and hence the tube, an a sensor 20, characterized in that the sensor 20 comprises a movable member 21 which communicates with the primary chamber and is mounted on the tube 4 for rotation therewith, and a fixed member 22 situated in the region of the axis of rotation of the tube 4 and so mounted relative to the tube 4 that rotation of the tube 4 does not rotate the fixed member 22, the fixed member 22 being adapted to be connected to means for measuring an electrical characteristic of the sensor 20, said fixed member 22 being mounted on the rotatable tube 4 by means of bearings 40 which enable the tube 4, to rotate about its axis relative to the fixed member 22, the arrangement being such that the movable member 21 moves in response to a temperature change or temperature related physical change in the primary chamber 6, thereby causing a corresponding change in the electrical characteristic of the sensor 20.

11. A heat pipe roller in which a liquid in an inner primary chamber 6 in a rotatable outer tube 4 is, in use, evaporated by a heater 10 ad subsequently condenses on an inner surface of the outer tube 4 to heat the latter, characterized in that the roller includes a secondary chamber 24 which communicates with the primary chamber 6, said secondary chamber 24 being relatively cool so that the non-condensible gas produced as a result of operation of the roller tend to collect in the secondary chamber 24.

* * * * *